United States Patent [19]

Ampolini et al.

[11] Patent Number: 4,602,472

[45] Date of Patent: Jul. 29, 1986

[54] METHOD AND APPARAUS FOR PACKAGING FIBROUS MATERIAL

[75] Inventors: Jacques F. Ampolini, Paoli; Tony S. Piotrowski, Ambler, both of Pa.

[73] Assignee: Certain-teed Corporation, Valley Forge, Pa.

[21] Appl. No.: 550,475

[22] Filed: Nov. 9, 1983

[51] Int. Cl.[4] ..... B65B 1/24

[52] U.S. Cl. ..... 53/438; 53/529; 100/232

[58] Field of Search ..... 53/436, 438, 523, 529, 53/544; 100/18, 78, 82, 233, 295, 42, 232; 198/372, 436, 598

[56] References Cited

U.S. PATENT DOCUMENTS

| | | | |
|---|---|---|---|
| 193,994 | 8/1877 | Peteler | 100/233 |
| 2,057,121 | 10/1936 | Trevellyan . | |
| 2,674,535 | 4/1954 | Meisler . | |
| 3,065,586 | 11/1962 | Ghiringhelli . | |
| 3,071,239 | 1/1963 | Burtness | 198/372 |
| 3,192,561 | 7/1965 | Archer et al. | 100/232 |
| 3,246,733 | 4/1966 | Torbet et al. | 198/372 |
| 3,329,083 | 7/1967 | Bellman . | |
| 3,458,966 | 8/1969 | Dunbar et al. . | |
| 3,564,993 | 2/1971 | Tezuka | 100/232 X |
| 3,585,925 | 6/1971 | Fox | 53/529 X |
| 3,614,850 | 10/1971 | Brochot | 53/438 |
| 3,717,973 | 2/1973 | Brady, Jr. . | |
| 3,811,242 | 5/1974 | Hayford et al. | 53/438 X |
| 3,822,526 | 7/1974 | Black | 100/295 X |
| 3,964,232 | 6/1976 | Bender et al. . | |
| 4,067,453 | 1/1978 | Moller | 198/485 X |
| 4,071,150 | 1/1978 | Thompson et al. | 414/612 X |
| 4,086,850 | 5/1978 | Becker et al. | 100/232 X |
| 4,177,723 | 12/1979 | Buchele et al. | 100/295 X |
| 4,372,101 | 2/1983 | Fleissner | 53/438 X |
| 4,483,245 | 11/1984 | Fetters | 100/233 X |

*Primary Examiner*—John Sipos
*Assistant Examiner*—Steven P. Weihrouch
*Attorney, Agent, or Firm*—Paul & Paul

[57] ABSTRACT

An apparatus and method is provided for packaging a fibrous, preferably compressible material; such as mineral fiber insulation shapes, in which the method and apparatus provides for delivering one or more such shapes (which are preferably rolls) through a staging area to a compression chamber in which they are compressed from a generally cylindrical shape or roll (or rolls) of a first diametral size, to a roll (or rolls) of a second, reduced diametral size, with the roll then being discharged from the compression chamber and being secured to substantially retain the cylindrical configuration of reduced diametral size, preferably by means of a sleeve or the like placed thereover. The operation occurs with a minimum of operator assistance, and may optionally be effected to occur automatically. The package formed may be of various roll lengths, and to this end, in the staging area prior to the compression chamber, the number of rolls that will be simultaneously compressed may be determined. Individual ones of the features are separately presented, such as the compression chamber, which employs a double stage compression, and a discharge arrangement that provides particular efficiency.

32 Claims, 8 Drawing Figures

METHOD AND APPARAUS FOR PACKAGING FIBROUS MATERIAL

BACKGROUND OF THE INVENTION

This invention relates to the packaging of compressible, generally fibrous material, and most particularly to packaging rolled mineral fiber e.g. fiberglass insulation. It will be understood hereinafter, that where reference is made to "fiberglass insulation rolls or the like", such reference is made to be representative, not limiting, in that other materials having packaging related characteristics similar to those of fiberglass insulation rolls may likewise be processed according to the method and apparatus of the present invention. For example, bags of insulation (preferably in bags of coarse mesh for air passage during compression) may be used, the shapes of which could be pillow-like or otherwise shaped and for purposes of this invention are considered to be sufficiently cylindrical and roll-like to be processed by this invention. Also, while this invention is preferably used to compress the roll-like shapes being packaged, compression is not an essential activity, in that, depending upon the size of the shape being packaged, it could conceivably be packaged by means of this invention without being compressed.

Various techniques have heretofore been employed to package fiberglass and like material. For example, the application of a package wrapper to fiberglass rolled material is disclosed in U.S. Pat. No. 3,717,973. Another fiberglass packaging apparatus is disclosed in U.S. Pat. No. 3,964,232. Still another method and apparatus is disclosed in U.S. Pat. No. 3,458,966.

In packaging rolled fiberglass insulation, it is becoming increasingly important that the insulation, if compressed, have a high degree of thickness recovery, because if such recovery is poor, considerable excess thickness is required prior to packaging in order for the product to have nominal thickness after unpacking. Also, in certain types of packaging, such as where a fiberglass roll is placed in a generally gas-impervious sleeve, which then has a vacuum drawn on it to pull the sleeve tightly around the package, it has been known that the size of the fiberglass roll may be reduced, but such has often resulted in undesirable substantial fiber breakage, and highly uneven compression, which in turn renders the resultant product often at least highly unsightly, if not unuseable.

Other types of packaging of fiberglass insulation mats are known, such as an alternating layer package (or zigzag packaging), but such packages can also yield undesirable fiber breakage at the location of the folds.

Nevertheless, it is highly desirable to, in some manner, reduce the size of fiberglass packages, to reduce the handling costs, to reduce the freight costs of transporting large bulky packages, and to obtain greater efficiency of storage.

THE PRESENT INVENTION

The present invention seeks to provide a novel method and apparatus for compressing rolls (including roll-like shapes) of fiberglass insulation or the like, by starting with fiberglass insulation rolls of generally cylindrical shape, and which are of a first diametral size, and then compressing those rolls, substantially evenly, to arrive at rolls of a reduced diametral size, still of generally cylindrical configuration. While such rolls are of the reduced diametral size, some size-retaining means, such as a sleeve or bag or other suitable retaining structure is applied over the rolls, to maintain them at the reduced size. Other particularly unique features of the present invention are likewise provided, such as the various delivering means and mechanisms, the several components of a staging area in which one or more rolls may be selected, separated, or brought together for compression and packaging together, and a particularly unique compression technique and arrangement.

A particular advantage resides in accordance with the present invention, in that the package thus formed, produces a compressed insulation roll of substantially reduced size with a minimum of fiber breakage and with localized fiber breakage substantially eliminated, with a high degree of uniform thickness recovery, with substantially reduced freight and warehousing costs for the final product, with reduced handling costs during packaging, and with reduced packaging material costs in packaging a smaller, compressed roll, instead of a larger substantially uncompressed roll.

Accordingly, it is an object of the present invention to provide an apparatus and method for packaging fiberglass insulation rolls or the like.

It is another object of this invention to accomplish the above object, in which techniques and apparatus are provided in a staging area for providing certain options in the packaging process.

It is a further object of this invention to provide a novel compression chamber for compressing fiberglass insulation rolls or the like of a first diametral size, to rolls of a reduced diametral size, both separately, and as part of an overall fiberglass roll packaging operation.

It is another object to accomplish the above objects, wherein means are provided for discharging one or more fiberglass insulation rolls from a compression chamber in such a way that allows for the efficient and/or automatic application of a diameter retention sleeve or other member thereto.

Other objects and advantages of the present invention will be readily apparent from a reading of the following brief descriptions of the drawing figures, the detailed descriptions of the preferred embodiments, and the appended claims.

BRIEF DESCRIPTIONS OF THE DRAWING FIGURES

In the Drawings:

FIG. 1 is a top plan view of an apparatus in accordance with this invention, wherein a delivery apparatus is provided in the form of several conveyors for delivering fiberglass insulation rolls to a kick-off zone, in which the rolls may be kicked either rightwardly or leftwardly, into one of two parallel compression chambers, for compression of the rolls and subsequent discharge of the rolls from the chambers.

Figure 1:
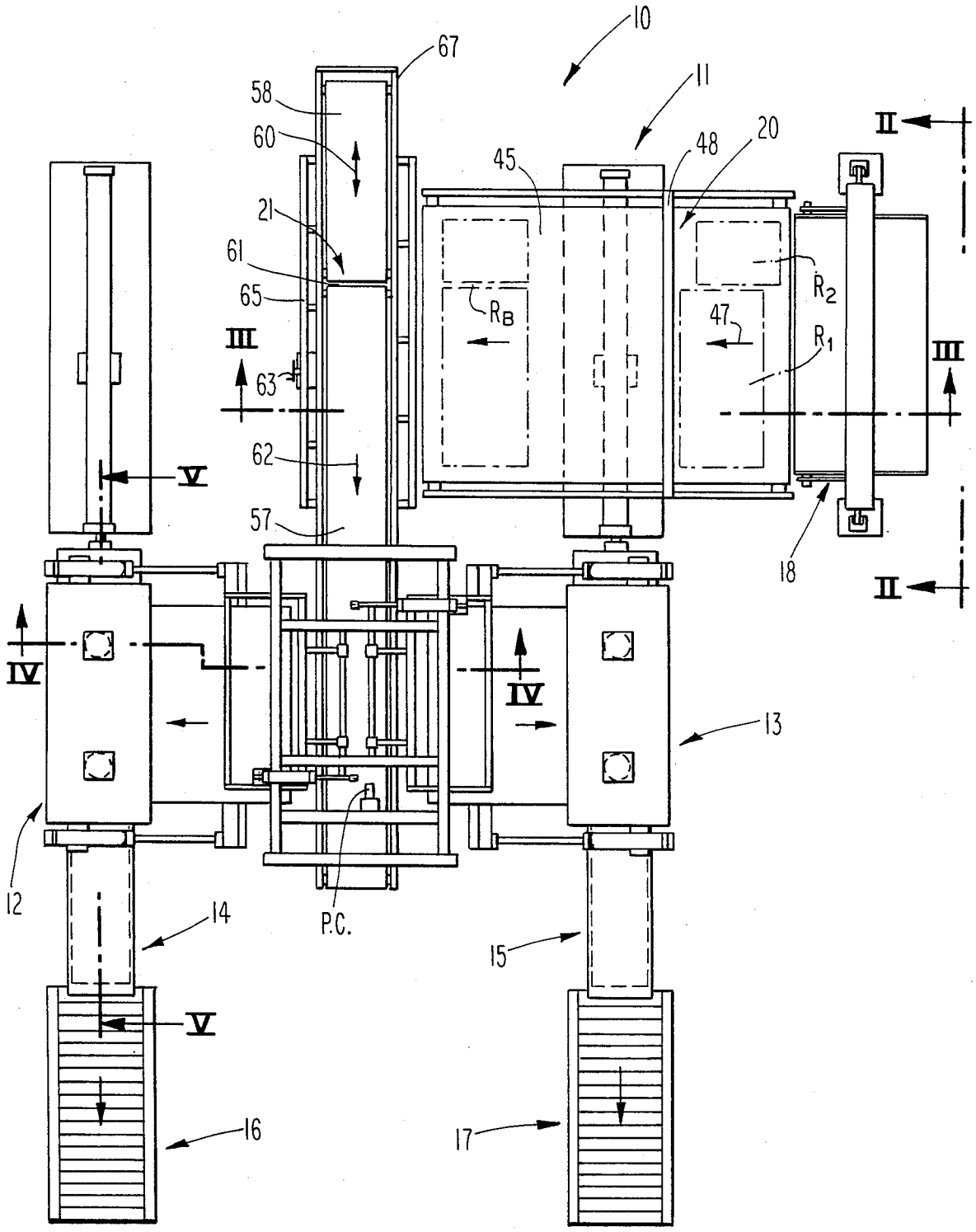
Figure 5:
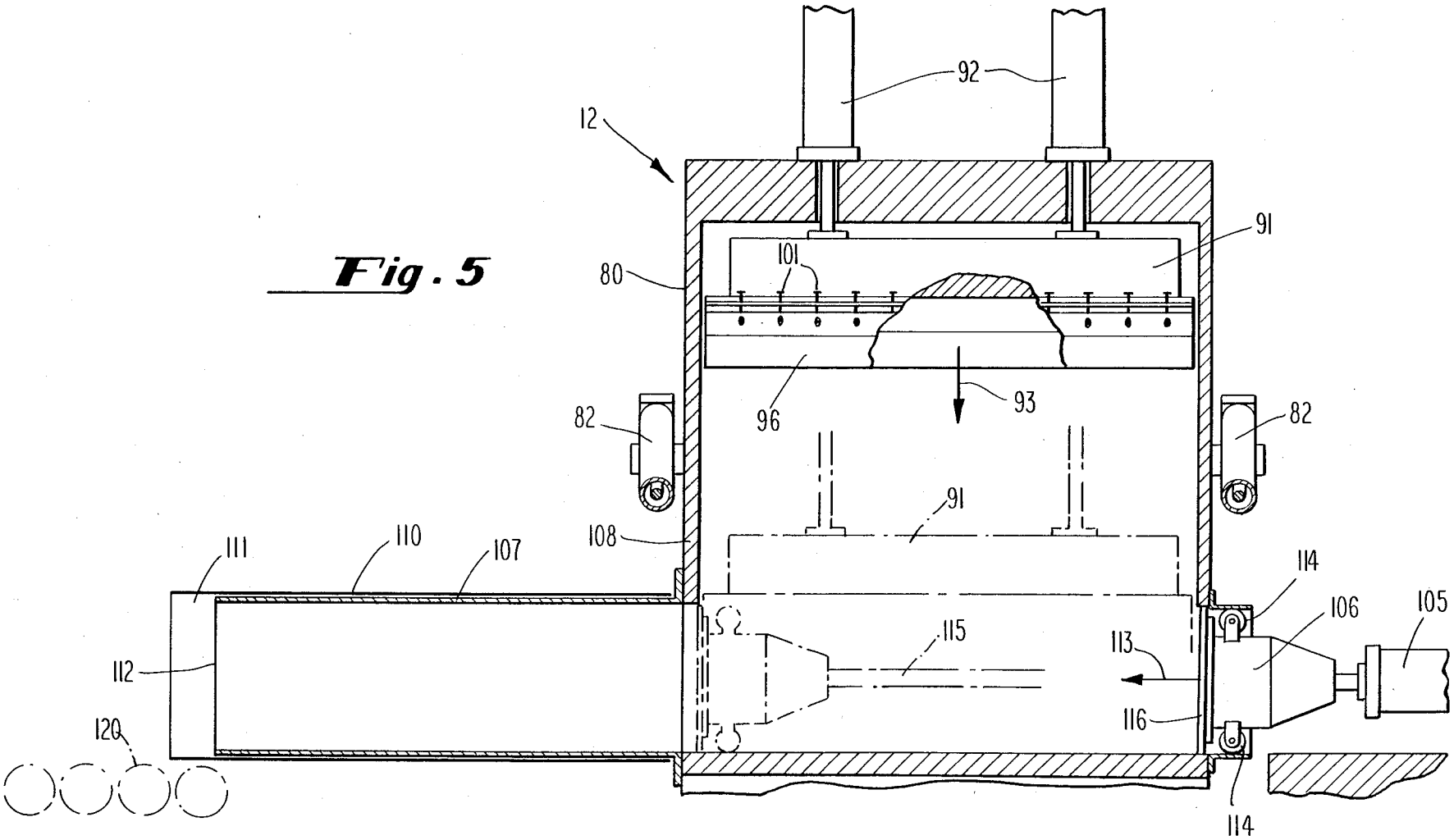

FIG. 5 is an enlarged fragmentary vertical sectional view taken through the compression chamber of this invention, generally along the line V—V of FIG. 1, and wherein both the vertically movable compression ram and the longitudinally movable discharge ram are illustrated in both full lines and phantom, with the full line illustrations therefor each being illustrative of the rams in their respective retracted positions.

Figure 4:
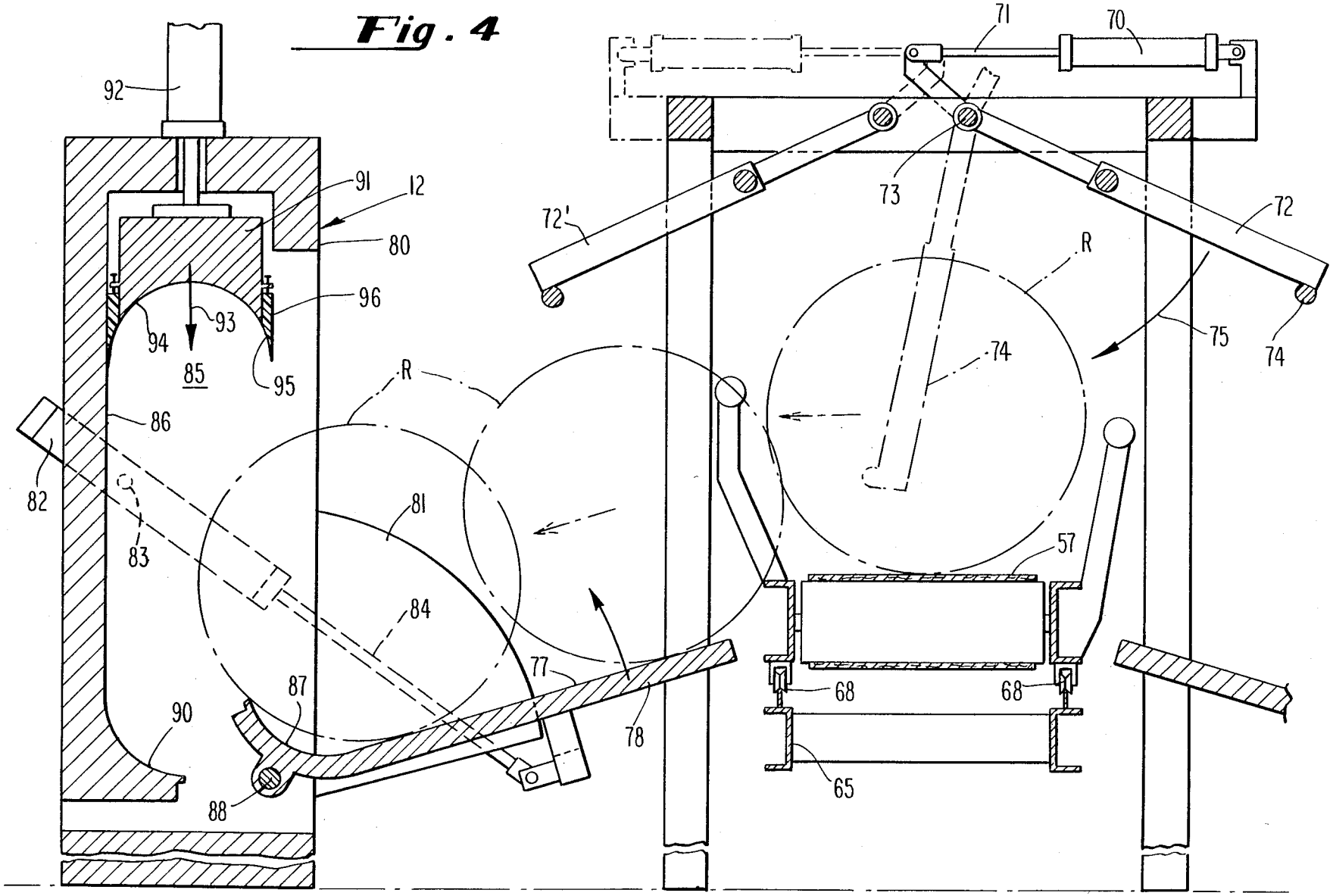
FIG. 4 is an enlarged fragmentary vertical sectional view taken through a portion of the conveying apparatus in accordance with this invention and the left-most compression chamber as viewed in FIG. 1, taken generally along the line IV—IV of FIG. 1, and wherein the progress of a roll is illustrated in phantom as it moves from right to left in FIG. 4.
Figure 6:
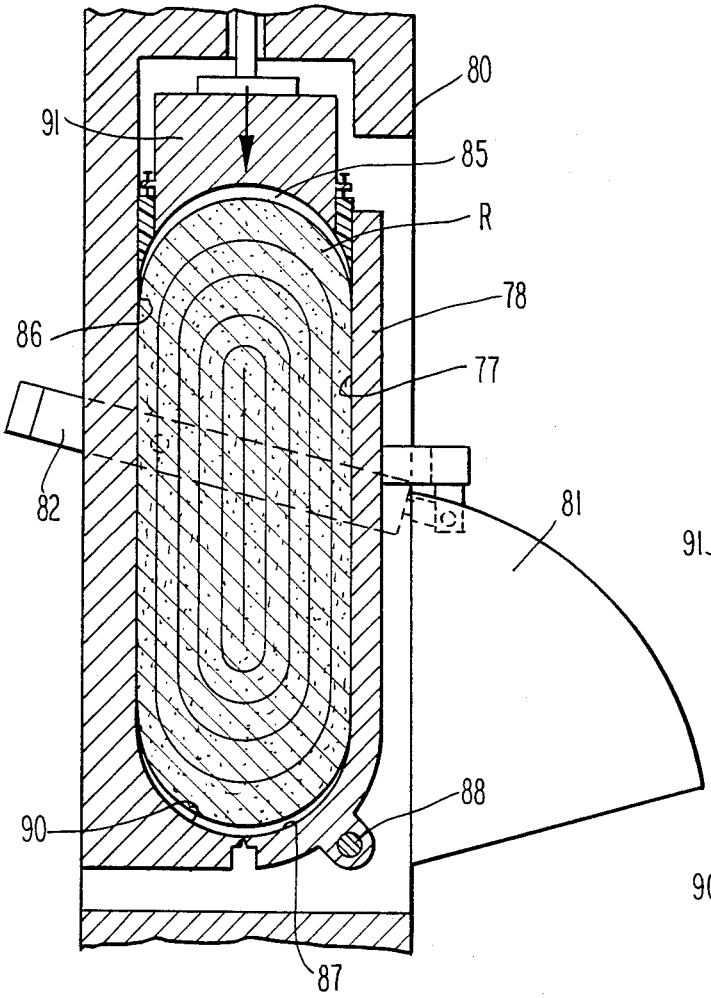

FIG. 6 is an enlarged fragmentary vertical sectional view taken through the compression chamber at the left end of FIG. 1, generally along the same line as that for the illustration of FIG. 4, but wherein the door of the compression chamber is shown in its closed position, in pressing relation to a roll of fiberglass disposed therein.

Figure 7:
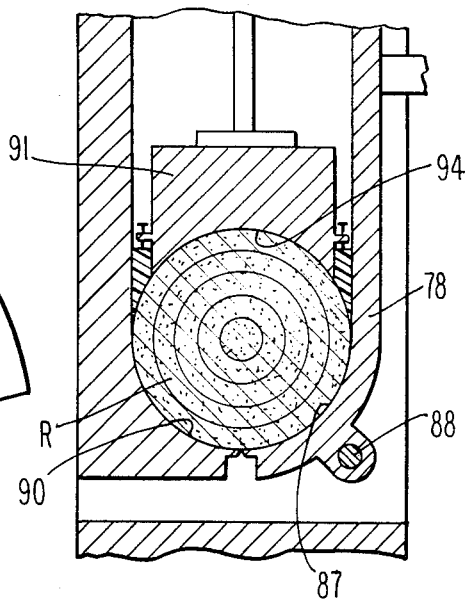

FIG. 7 is a partial fragmentary illustration of the chamber of FIG. 6, but wherein the compression ram is shown in its extended, compressing position, and with the compressed fiberglass roll in a cylindrical configuration of reduced diametral size, prior to discharge of the roll from the chamber.

Figure 8:
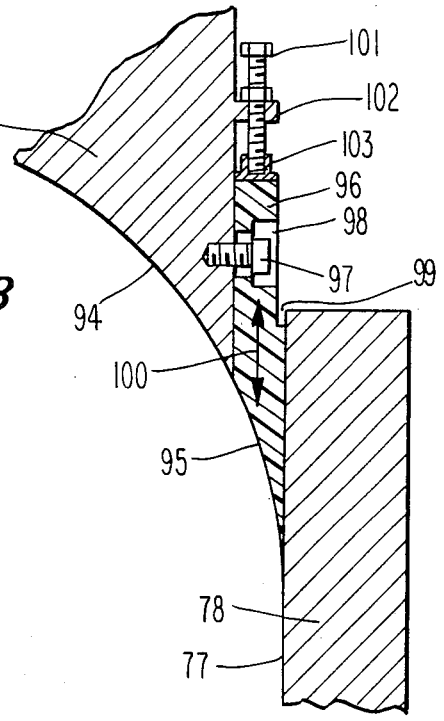

FIG. 8 is a highly enlarged fragmentary vertical sectional view, taken through a portion of the compression chamber and compression ram of FIGS. 6 and 7, but wherein a wall or door wiper is particularly illustrated in detail.

DETAILED DESCRIPTIONS OF THE PREFERRED EMBODIMENTS

Referring now to the drawings in detail, reference is first made to FIG. 1, wherein the packaging apparatus of this invention is generally designated by the numeral 10, as comprising a delivering zone 11, two compression zones 12 and 13, and two zones 14 and 15 for applying sleeves, wrappers, or suitable retention means to hold compressed rolls in their compressed condition, after which the rolls are delivered to take-off conveyor zones 16 and 17, respectively.

The delivering zone 11 includes an elevator or lifting apparatus 18, a lateral conveyor apparatus 20, and a longitudinal conveyor apparatus 21.

Figure 2:
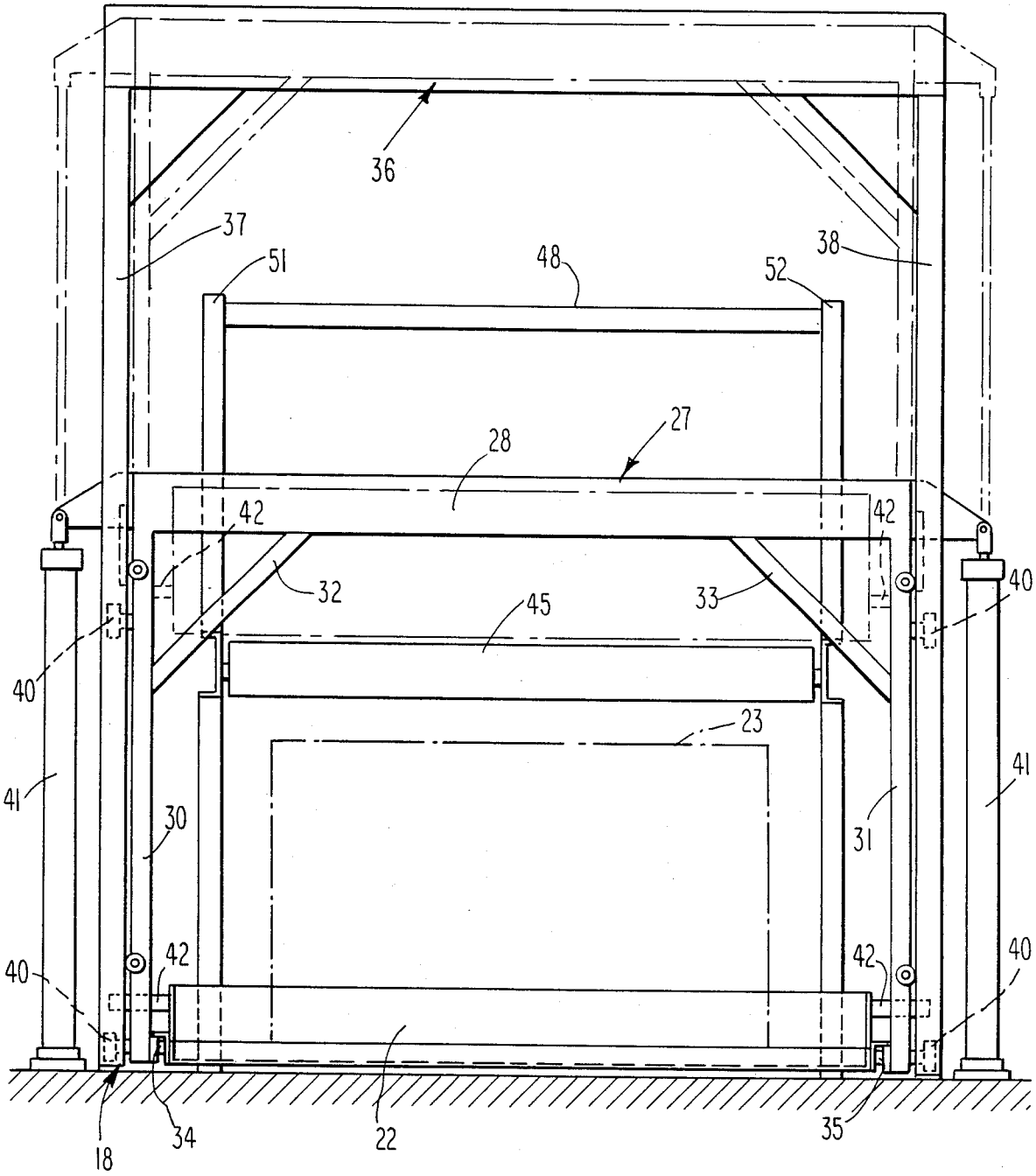
FIG. 2 is an enlarged elevational view of an elevator or lifting portion of the conveying apparatus of this invention, taken generally along the line II—II of FIG. 1.
Figure 3:
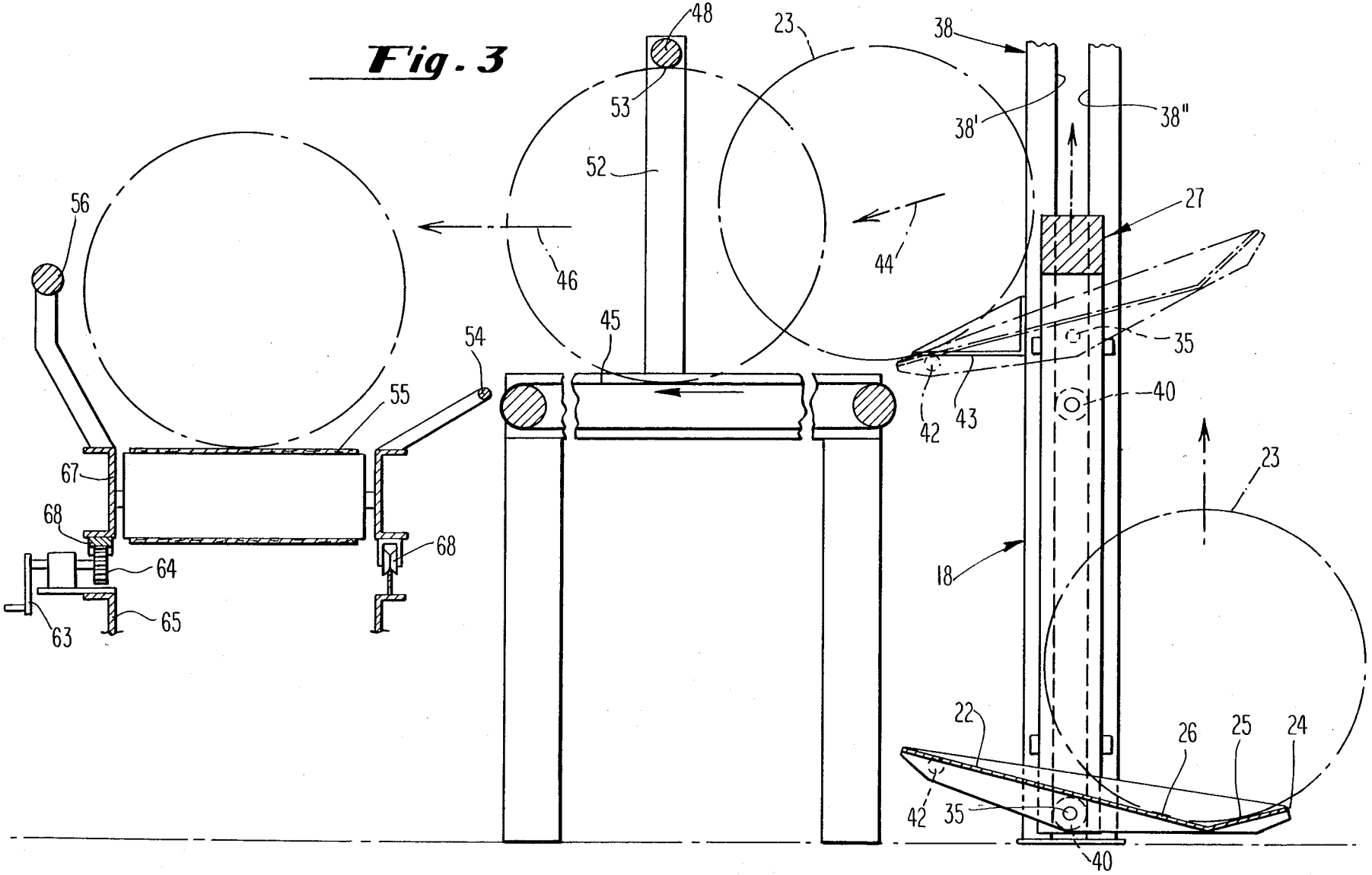
FIG. 3 is an enlarged vertical, sectional view, taken through several of the conveying apparatus of this invention, generally along the line III—III of FIG. 1, and wherein the progress of a roll being handled by the apparatus is progressively illustrated in phantom as it is first raised, and then moved from right to left, as viewed in FIG. 3.

With particular reference to FIGS. 2 and 3, the elevator or lifting apparatus 18, which is shown as presenting at its lower end, a lifting shelf 22 which is adapted to receive a roll 23 of fiberglass insulation or the like thereon, for example as being rolled over a forward lip 24 thereof, to be nestled between the sloped surfaces 25 and 26 thereof.

The shelf 22 is carried in a movable guide frame 27, comprised of a horizontal bar 28 and two vertical bars 30 and 31 that in turn are interconnected by suitable angle struts 32 and 33, for rigidity upon movement. At the lower ends of the vertical frame members 30 and 31 there are provided pivot means 34 and 35 which pivotally engage with the shelf 22, for pivotal movement of the shelf 22 with respect to the frame member 27. The frame member 27 is in turn, carried for vertical movement relative to a stationary frame 36. The stationary frame 36 has vertical supports 37 and 38 that also act as guides for the movement of vertically movable frame 27 therein, with suitable roller wheels or the like 40 serving to roll and guide the frame 27 in its vertical movement, as the rollers 40 traverse inner guide walls 38′ and 38″.

The upward movement of the frame 27 and of the shelf 22 through the lift provided by pivots 34 and 35, is powered by suitable drive cylinders 41 that may be of any suitable type, but which preferably are pneumatic cylinders, for moving the frame 27 between the full line position therefor illustrated in FIG. 2, to the phantom line position therefor illustrated at the upper end of FIG. 2, in providing the lifting action for the shelf 22 from the full line position therefor illustrated in FIG. 3, to the phantom position therefor illustrated at the upper end of FIG. 3.

In the upward movement of the shelf 22, tilt pins 42 that protrude from each end of the shelf, engage stops 43 carried by the fixed frame member 38, and prevent further upward movement of the left-most end of the shelf 22 as viewed in FIG. 3. Consequently, further upward movement of the movable frame 27 causes a slight counterclockwise pivoting of the shelf 28 about pivot point 35, facilitating discharge of an uncompressed roll 23 therefrom in the direction of the arrow 44 illustrated in FIG. 3. It will be understood that the operation of the cylinders 41 may be programmed for automatic operation or the like, if desired, or the same can be done by an operator, depending upon circumstances and operations.

It will also be understood that while reference is made to a roll 23 at this stage of the explanation, it will be understood that the roll is as yet uncompressed and may, for example, be 38 inches or more in diameter. It will also be understood, that while reference at this point is made to a roll, the roll may actually be a "roll means", comprising one or more such rolls abutted together, end-to-end (longitudinally), and in such case will generally have been made from the same matt that was slit, with the one or more rolls having been simultaneously rolled from the flat mat configuration to a roll configuration. As aforesaid, the article(s) being packaged may initially be of various shapes, or in bags or the like, and there may be one or more disposed endwise. Generically, such will be referred to herein as "shape means", although it will be understood that this invention is especially useful for handling roll means.

Thus, as the roll or rolls are discharged from the shelf 22 onto the lateral conveyor section 20 of the delivery zone 11, they land on an upper run 45 of said lateral conveyor, for delivery in the direction of the arrow 46 of FIG. 3, or the arrow 47 of FIG. 1, with the conveyor belt 45 being drivable from a suitable power source.

If the roll means being thus delivered actually comprises two rolls, arranged end-to-end but otherwise unconnected except for any impingement of fiberglass fibers from the end of one roll with fibers of the next adjacent roll, it is possible that the rolls $R_1$ and $R_2$ become separated such that one of the rolls, for example $R_1$ will advance ahead of the other roll $R_2$. In order that, following the discharge from the shelf 22, such rolls may be brought together for further handling in a longitudinal direction, an alignment bar 48 is provided carried by suitable vertically adjustable upstanding supports, 51 and 52. The function of the alignment bar 48, is that, in the event that any of the rolls $R_1$ and $R_2$ have become unaligned as illustrated in FIG. 1, the forward-most moving roll $R_1$ will impinge at its upper end against the lower end 53 of the bar, as illustrated in FIG. 3, until the other roll $R_2$ likewise approaches the bar 48. At that point, if the operation is operator-controlled, the conveyor 20 may be actuated to drive the rolls leftward, to the longitudinal conveyor section 21. If the operation is automatic, suitably located photocells may be used to sense the alignment of the rolls $R_1$ and $R_2$ for further transport of the rolls along the upper run 45 of conveyor 20.

The roll or rolls are then next delivered to the longitudinal conveyor section 21, where, as shown in FIG. 3, they drop over a suitable guide 54, down onto upper run 55 of said conveyor stopping against a suitable adjustable stop bar 56. The bar 56 will be vertically adjustable by any suitable means, not shown, to act as a stop for roll sizes of various diameters and will generally be pre-set for a given roll diameter size being run.

At this point, the operator may make an election, at his option, depending upon the desired size and quantity of the rolls to be included within a single final package.

With particular reference to FIG. 1, it will be noted that the longitudinal conveyor section 21 includes a larger generally forwardly driven section 57, and a rearward section 58, optionally drivable in either a forward or reverse direction, as indicated by the double headed arrow 60 in FIG. 1. The two conveyor sections 57 and 58 have a parting zone 61 therebetween. Thus, if two rolls of the general longitudinal sizes for the rolls $R_1$ and $R_2$ illustrated in FIG. 1 reach the conveyor section 21, and it is desired to package only a roll of the size $R_1$, the operator may actuate the conveyor section 58 to travel in a reverse direction, or vertically upwardly as viewed in the plane of the paper in FIG. 1, whereupon the roll $R_2$ will be held on conveyor section 58, as a staging area, while the roll $R_1$ can be moved longitudinally in the direction of the arrow 62 shown in FIG. 1. On the other hand, if it is desired to package one, two, or more rolls $R_1$, $R_2$, etc. together in a single package, upon those rolls reaching the conveyor section 21, both sections 57 and 58 will be driven in the direction of the arrow 62, so that all such rolls may be delivered to a compression zone 12 or 13 simultaneously.

It will be apparent from the foregoing that various arrangements and combinations may be made, insofar as roll size packaging is concerned. For example, in some instances several rolls may be combined into a single package. In other instances only a single roll may be placed in a given package, but the present invention permits various options and flexibility.

Depending upon the location of a roll breaking zone $R_B$, as indicated in FIG. 1, the parting zone 61 for the conveyor section 21, between conveyors 57 and 58, may be moved longitudinally (either upwardly or downwardly as viewed in FIG. 1), by activation of a crank handle 63, so that the entire conveyor section 21 may be moved either in a forward or reverse direction, by grasping the crank 63 and moving it in either a clockwise or counterclockwise direction, to place the parting zone 61 at various locations longitudinally. In so driving the conveyor section 21, the crank 63 will turn a pinion gear 64 carried by a stationary frame structure 65, with the pinion gear 64 engaging teeth of a rack 66 that is carried by a movable frame structure 67 of the conveyor section 21, and thereby move the conveyor section 21 in a longitudinal direction in the matter aforesaid. In so doing, suitable roller guides or the like 68 may be provided for smooth movement.

Reference is now made to FIG. 4, wherein the roll or rolls that comprise the roll means have now been delivered by means of the conveyor 57, to a kick-off position between the two compression zones 12 and 13, as is indicated by the phantom roll means in FIG. 4. At this point, the longitudinal movement of the conveyor 57 is discontinued, either by the operator if the operation is proceeding manually, or preferably upon hitting a suitable stop indicator, such as a limit switch or a photocell P.C. The selection is then permitted whereby the roll R may be kicked-off to one of the compression zones 12 or 13. In the embodiment illustrated in FIG. 4, the compression zone or apparatus 12 is the one that is to receive the roll means R.

Upon making the selection to use the compression chamber 12, a cylinder 70 will then be actuated, retracting its rod 71 inward, and causing the lateral discharge of the roll means R by means of pivoting a pusher or kicker arm 72 about a pivot 73, such that its kicker rod 74 engages the cylindrical surface of the roll means R as the kicker structure 72 is moved in the direction of the arrow 75 of FIG. 4, from the full line position for the kicker structure 72, to the phantom line position 76 thereof, whereby the roll means R will be caused to leave the conveyor 57, to pass onto the inner wall 77 of an open front door 78 of the compression chamber 80, with the open door 78 functioning as an entry ramp for the roll means R, with the roll means R at its ends passing between a pair of chamfer-like chamber-entering guides 81. At this point, the door 78 may be closed, by suitable photocell or operator actuation of a power door closer, such as a pneumatically driven cylinder 82 or the like, pivotally carried as at 83, on an exterior wall of the chamber 80, to cause a retraction of the drive rod 84, to pull the door 78 shut, with the roll means R being compressed within the cavity 85 of the chamber, as shown in FIG. 6. It will be apparent that, if the compression zone 13 was to be utilized, a kicker arm 72' would kick the roll means R in the opposite direction, with similar components related to the kicker 72' functioning in mirror-image relation to those components that operate the kicker 72.

It will thus be seen that the roll means R is compressed from its generally cylindrical configuration of a first diametral size as illustrated in FIG. 4, to a generally flattened oval configuration as illustrated in FIG. 6, substantially filling the cavity 85, with such compression taking place between the front door 78 and the back wall 86 of the compression chamber.

It will be noted that the lower end of the door 78 as viewed in FIG. 4 is concavely curved as illustrated at 78, with the curve being substantially that of one-quarter of a perfect cylinder, such that, when the door 78 is closed by pivoting it about pivot pin 88 in a manner aforesaid, the curved surface 87 of the door will mate with the correspondingly curved surface 90 at the lower end of the back wall 86 of the compression chamber, such that between the two curved surfaces 87 and 90 they effect a substantially complete semi-cylindrical surface.

At this point, a compression ram 91 may be actuated by means of operator actuation of a pair of drive cylinders 92, to drive the compression ram 91 generally vertically downwardly, in a direction of the arrows 93 indicated in FIGS. 4 and 5. It will be understood that the cylinders 92, while preferably being operator actuated, may, again, also be actuated automatically by means of suitable photocells, once the roll means R are in place in the chamber 85. The compression ram 91 thus moves from a position as illustrated in full lines at the upper end of FIG. 5, to the phantom position illustrated therefor, and in so doing, compresses the roll means R in the chamber 85, to a compact cylindrical configuration as illustrated in FIG. 7.

It will be apparent that the lower surface 94 of the ram 91 is configured so as to describe a generally semi-cylindrical configuration substantially of the desired final size of the roll means R in its compressed state. In this regard, the surface 94 is aided by surface portions 95 of wiper elements 96 carried by the ram 91. With particular reference to FIG. 8, it will be seen that the wiper surfaces 95 are also arcuately curved to complete the semi-cylindrical configuration provided by the entire ram. However, it will be noted, that in practice, the material of construction of the wiper 96 will generally be of a low friction construction, such as a thermoplastic, for slidingly wiping the vertical walls 77 or 86 during vertical downward movement of the ram 91. Consequently, for ease of manufacture, the surfaces 95 of the wipers 96 may be cut flat, inasmuch as they occupy a very slight chordal component of the cylindrical surface, and in fact, with wear, may approach a true arcuate, cylindrical component. In any event, it will be apparent that, upon compression of the roll means R in the cavity 85 as illustrated in FIG. 6, the fiberglass material will compress against the inner surfaces 95 of the wipers 96, and press them outwardly against the wall surfaces 77 or 86 of the cavity 85, and thus keep the wipers 96 in close sliding contact with the walls 77 or 86.

The wipers 96 at their upper ends are mounted by means of a plurality of cap headed screws or the like 97 extending through vertical slots 98 in the wipers 96, and threadingly engaged in the ram 91. The vertical slots 98 permit a certain amount of vertical adjustment, upwardly or downwardly, in the direction of the double headed arrow 100 illustrated in FIG. 8. Such adjustment may be effected, by means of a plurality of manual adjustment screws 101 threadably carried in suitable mounting blocks 102 that in turn are carried by the ram 91, with the lower ends of the screws as illustrated in FIG. 8 being in turn captively engaged with the upper ends of the wipers 96, as at 103. Thus, the wipers 96 may be adjusted, generally downwardly, to compensate for wear against their surface 95. Eventually, the wipers 96 will be replaced, as the wear becomes too great, and in order to accommodate wear, the wipers 96 are recessed as at 99.

At this point, the roll means R has been compressed to a generally cylindrical configuration of a reduced diametral size.

Reference is next made to FIG. 5, wherein a pneumatic cylinder or the like 105 will generally be operator-actuated, to cause a discharge ram 106 to discharge the compressed roll means R from a compression chamber. Such activation may again be operator-controlled or automatic, as is desired. However, it will generally first be desired to already have means in place to retain the compressed roll means in its reduced diametral size. To this end, it will be noted that a discharge snout 107 is provided at the left end of the compression chamber found in FIG. 5, suitably sized to receive the compressed roll means. The snout 107 is generally a cylindrical tubular member, carried by the wall 108 of the compression chamber and is adapted to receive thereon a thermoplastic, paper, or otherwise constructed sleeve 110, preferably with a portion 111 of the sleeve protruding beyond the end 112 of the discharge snout. When the sleeve 110 is in place, a signal may be activated, either manually or by means of a suitable photocell (not shown), or the like, to signal the operator of the equipment that it is time to actuate the cylinder 105. Then, the cylinder 105 will drive the discharge ram 106 leftwardly as viewed in FIG. 5, in the direction of the arrow 113, and the discharge ram 106, guided in its leftward movement by suitable rollers 114 carried thereby and rolling against the inside surface of the now-compressed compression chamber cavity 85, will discharge the compressed roll means R into the snout 107. It will be apparent that, depending upon the longitudinal length of the roll or rolls comprising the roll means in the cavity 85, and, depending upon the length of the roll means just-previously-discharged from the compression chamber, if desired, the length of stoke for the discharge ram rod 115 may be suitably set by the operator or by a preprogrammed signal prior to activation of the cylinder 105.

Desirably, the ram 106 will have a plate 116 sized to fit in close sliding relation along the cylindrical wall of the inside of the compression chamber 85, as the ram 106 progresses in its travel, and the slide plate 116 will also preferably be constructed of a thermoplastic or other readily slidable material relative to the material of construction of the compression chamber.

Most desirably, the length of stroke selected or preprogrammed for the ram 106 will be such to push a first roll means R through the snout 107, an amount sufficient that the forward-most portion of the first roll means will advance to just before the end 112 of the snout, to keep the sleeve from being prematurely drawn off the snout, and that when the ram 106 pushes a second roll means R through the snout 107 said advancing second roll means R will cause the first leftward-moving compressed roll means R to pull the tubular wrapper 110 with it, sliding leftward over the exterior of the snout 107, such that the entire wrapped package will be delivered onto the conveyor rollers 120 of one of the conveyor sections 16 or 17.

It will be apparent from the foregoing that various other features and modifications of the apparatus will be apparent, all within the spirit and scope of the invention as described and claimed. For example, it will be apparent that some other retaining means may be used other than the sleeve 110, for keeping the discharged roll or rolls in their final size, but that some means will be needed to wrap the compressed rolls. For example, within the spirit of this invention, it is conceivable that bands of some type may be applied, but that preferably a wrapper 100 will be utilized. It is also apparent that the wrapper 110 could include a bag having a bottom thereon, across the open left end as viewed in FIG. 5, if desired. Similarly, it will be apparent that the size of the final package may vary, dpending upon the output limitations provided by the compression chamber and its discharge snout. While the present invention is particularly addressed to providing packages of one or more rolls, it is not limited to any particular diameter, said diameter being determined by selecting the diameter of the snout, the cross-sectional size of the compression chamber, etc. Also, it will be understood that the apparatus can be used to package shapes that are or are not rolls and which are not of a transverse dimension larger than the diameter of the cylindrical cavity formed when the ram 91 is in the FIG. 7 position, and not of a transverse dimension larger than the opening in the snout 107, in which case there will actually be no compressing function effected by the ram 91 nor by the closing of the door 78. Also, while the present invention is principally addressed to packaging rolled fiberglass mat, it is conceivable that other similar products may be utilized in the same or similar types of equipment, all within the spirit and scope of the invention as defined in the appended claims.

What is claimed is:

1. In an apparatus for packaging generally cylindrical compressible material rolls or the like:

(a) means for delivering generally cylindrically configured roll means of a first diametral size to a compression chamber means;

(b) compression chamber means for compressing the roll means to a generally cylindrical configuration of a second reduced diametral size;

(c) means for discharging the roll means of reduced diametral size from said compression chamber means; and (d) means for holding and facilitating the application of a diameter retention means to the roll means while the roll means is in a generally cylindrical configuration of reduced diametral size; wherein said compression chamber means includes at least one compression chamber, said chamber including front and back wall portions for receiving roll means therebetween and first laterally compressing the roll means between the front and back wall portions into a laterally flattened roll configuration in a cavity therebetween, wherein said front wall portions comprise an openable front door for receiving roll means from said delivery means and for conveying the roll means toward said back wall portion in a ramp-like manner and for laterally compressing the roll by closing said front door wherein said compression chamber also includes compression ram means for thereafter engaging an unflattened peripheral portion of the roll means in the chamber, including means for driving the compression ram means from a retracted position to an extended position for compressing the roll means from a flattened roll configuration to a generally cylindrical roll configuration of reduced diametral size.

2. The apparatus of claim 1, wherein said means for delivering include vertical lifting means for receiving a roll means and lifting it upwardly, and with means being provided for tiltingly discharging roll means from said lifting means upon the roll means reaching a predetermined height.

3. The apparatus of claim 1, wherein said delivering means include lifting means and lateral conveyor means for receiving the roll means from the lifting means and conveying the roll means laterally.

4. The apparatus of claim 3, including alignment bar means disposed above said lateral conveyor means, for engagement of a plurality of unaligned rolls of the roll means thereagainst while the lateral conveyor means is moving the rolls under the alignment bar means, for longitudinally aligning rolls of the roll means that may have become misaligned.

5. The apparatus of claim 1, wherein said delivering means include longitudinal conveyor means for receiving the roll means and conveying it longitudinally toward said compression chamber means.

6. The apparatus of claim 5, wherein said longitudinal conveyor means comprise a first, forward moving conveyor section for conveying roll means forward, and second conveyor section generally aligned with said first section, for selectively conveying roll means rearwardly or forwardly, as desired, for optional longitudinal separation of rolls of the roll means.

7. The apparatus of claim 6, including means for adjustably moving the longitudinal conveyor means in a longitudinal direction, forwardly or rearwardly, for adjusting a partition zone between said first and second conveyor sections, for correspondingly adjusting the longitudinal separation location thus formed of rolls of the roll means.

8. The apparatus of claim 7, wherein said means for adjustably moving comprise a manual crank means.

9. The apparatus of claim 5, wherein said delivering means includes lateral discharge means for discharging the roll means laterally of said conveyor means, to said compression chamber means.

10. The apparatus of claim 5, wherein said compression chamber means comprise a pair of compression chambers, one mounted on each side of said longitudinal conveyor means, and wherein said delivering means also includes a pair of lateral discharge means, selectively operable for optionally discharging roll means from said longitudinal conveyor means into a selected one of said conveyor chambers.

11. The apparatus of claim 10, wherein said lateral discharge means comprise lateral kicker means for engaging and rolling a roll means from an elevated location on said longitudinal conveyor means, off said conveyor means to a said compression chamber.

12. The apparatus of claim 1, further including force multiplier means for urging shut said front door against the compression resistance of the roll means in said compression chamber.

13. The apparatus of claim 1, wherein said chamber defines a generally cylindrical internal cavity when said compression ram means is in its extended position.

14. The apparatus of claim 12, wherein said front door and said back wall portion together define a generally semi-cylindrical configuration in said cavity.

15. The apparatus of claim 14, wherein said compression chamber includes compression ram means for engaging an unflattened peripheral portion of the roll means in the chamber, including means for driving the compression ram means from a retracted position to an extended position for compressing the roll means from a flattened roll configuration to a generally cylindrical roll configuration of reduced diametral size.

16. The apparatus of claim 1, wherein said front and back wall portions include flat wall portions, and wherein said compression ram means presents generally semi-cylindrical concave surface configuration to a roll means in said cavity, said generally concave configuration terminating at said wall portions in wiper means for slidingly wiping said wall portions as said compression ram means moves from a retracted position to an extended position while compressing the roll means.

17. The apparatus of claim 1, wherein said means for discharging the roll means includes a discharge means for traversing at least a portion of the interior of said compression chamber means, for discharging the roll means therefrom.

18. The apparatus of claim 13, wherein said means for discharging the roll means includes a discharge ram means for longitudinally traversing at least a portion of said cavity while the said compression ram means is in an extended position, for discharging the roll means from the cavity.

19. The apparatus of claim 1, wherein the means for holding and facilitating the application of diameter retention means includes a generally cylindrical sleeve member receivingly communicating with said compression chamber means for receiving a roll means discharged therethrough, with said sleeve member being adapted to carry a retention member thereon to be engaged by a roll means being discharged from the sleeve member.

20. The apparatus of claim 13, wherein the means for holding and facilitating the application of diameter retention means includes a generally cylindrical sleeve member receivingly communicating with said cavity, for receiving a roll means discharged thereinto by said ram means.

21. The apparatus of claim 20, wherein said sleeve member is sized and arranged to facilitate carrying thereon a wrapping sleeve of a size corresponding generally to the reduced diametral size of the roll means.

22. The apparatus of claim 20, wherein said means for discharging the roll means includes a discharge ram means for longitudinally traversing at least a portion of said cavity while the said compression ram means is in an extended position, for discharging the roll means from the cavity, including means establishing the stroke of said ram means whereby one roll means in the cavity pushes a next-previously discharged roll means through said cylindrical sleeve means.

23. A compression chamber apparatus for compressing generally cylindrical roll means of insulation or the like from a first diametral size to a generally cylindrical configuration of a second reduced diametral size, comprising a compression chamber, said chamber including front and back wall portions for receiving roll means therebetween and first laterally compressing the roll means between the front and back wall portions into a flattened roll configuration in a cavity therebetween, wherein said front wall portions comprise an openable front door for receiving roll means from a delivering means and for conveying the roll means toward said back wall portion in a ramp-like manner and for laterally compressing the roll by closing said front door wherein said compression chamber includes compression ram means for therafter engaging an unflattened peripheral portion of the roll means in the chamber, including means for driving the compression ram means from a retracted position to an extended position for compressing the roll means from a flattened roll configuration to a generally cylindrical roll configuration of reduced diametral size.

24. The apparatus of claim 23, further including force multiplier means for urging shut said front door against the compression resistance of the roll means in said compression chamber.

25. The apparatus of claim 24, wherein said front door is pivotally carried by the chamber for movement between open and closed positions.

26. The apparatus of claim 23, wherein said chamber defines a generally cylindrical internal cavity when said compression ram means is in its extended position.

27. The apparatus of claim 23, including means for discharging roll means from the compression chamber, which includes a discharge ram for traversing at least a portion of the compression chamber for discharging the roll means therefrom, and a generally tubular discharge chute for receiving a roll means discharged therefrom.

28. The method of packaging generally cylindrical compressible material rolls or the like, comprising the steps of:

(a) delivering roll means having a generally cylindrical configuration of a first diametral size to a compression chamber;

(b) compressing the roll means in the compression chamber into a generally cylindrical configuration of a second reduced diametral size;

(c) discharging the roll means from the compression chamber; and (d) applying a diametral retention member to the roll means upon its discharge from the chamber; wherein the compressing step includes loading the roll means onto an inclined front door of a compression chamber to thereby feed said roll into thereby feed said roll into said compression chamber in a ramp-like manner and then closing the chamber door to first lateraly compress the generally cylindrical roll means into a generally flattened oval-like configuration by closing the door, then compressing the flattened oval-like configuration into a generally cylindrical configuration having a diameter substantially equal to the shorter dimension measured across the oval-like configuration.

29. The method of claim 28, wherein the delivering step includes selecting one or more rolls from the roll means and retaining any unselected rolls against immediate delivery to the compression chamber.

30. The method of claim 28, wherein the discharging and applying steps include discharging the roll means through a tubular opening member that carries a sleeve-like retention member, whereby the roll means engages the retention member and withdraws the retention member from the tubular opening member, onto the roll means.

31. The method of claim 30, wherein the discharging step includes the use of a roll means being discharged from the chamber to push a next previously discharged roll means through the tubular opening member.

32. The method of claim 28, wherein the delivering step includes selecting one or more rolls from the roll means and retaining any unselected rolls against immediate delivery to the compression chamber, wherein the compressing step includes loading at least one roll into a compression chamber and then closing the chamber to first compress the one or more generally cylindrical rolls into a generally flattened oval-like configuration, then compressing the flattened oval-like configuration into a generally cylindrical configuration having a diameter substantially equal to the shorter dimension measured across the oval-like configuration, and wherein the discharging and applying steps include discharging that one or more rolls through a tubular opening member that carries a sleeve-like retention member, whereby that one or more rolls engages the retention member and withdraws the retention member from the tubular opening member, onto that one or more rolls.

* * * * *

UNITED STATES PATENT OFFICE

CERTIFICATE OF CORRECTION

Patent No. 4,602,472 Dated July 29, 1986

Inventor(s) Jacques F. Ampolini and Tony S. Piotrowski

It is certified that error appears in the above-identified patent and that said Letters Patent are hereby corrected as shown below:

Column 10, line 24 (claim 10, line 8):

change "conveyor" to --compression--.

Column 12, line 20 (claim 28, line 17):

delete "thereby feed said roll into", in order to avoid a double inclusion.

Signed and Sealed this

Eleventh Day of November, 1986

*Attest:*

DONALD J. QUIGG

*Attesting Officer* *Commissioner of Patents and Trademarks*